US009576561B2

(12) United States Patent
Thompson

(10) Patent No.: US 9,576,561 B2
(45) Date of Patent: Feb. 21, 2017

(54) PICK FOR STRINGED MUSICAL INSTRUMENTS

(71) Applicant: Jonathan Mark Thompson, Lake Forest, CA (US)

(72) Inventor: Jonathan Mark Thompson, Lake Forest, CA (US)

( * ) Notice: Subject to any disclaimer, the term of this patent is extended or adjusted under 35 U.S.C. 154(b) by 0 days.

(21) Appl. No.: 14/600,087

(22) Filed: Jan. 20, 2015

(65) Prior Publication Data

US 2015/0206516 A1 Jul. 23, 2015

Related U.S. Application Data

(60) Provisional application No. 61/930,605, filed on Jan. 23, 2014.

(51) Int. Cl.
*G10D 3/16* (2006.01)

(52) U.S. Cl.
CPC ..... *G10D 3/163* (2013.01)

(58) Field of Classification Search
CPC ..... G10D 3/163
USPC ..... 84/322; D17/20
See application file for complete search history.

(56) References Cited

U.S. PATENT DOCUMENTS 7,462,768 B2 * 12/2008 Newmaster ..... 84/322
2006/0081109 A1 * 4/2006 James ..... 84/322

* cited by examiner

*Primary Examiner* — Jianchun Qin

(57) ABSTRACT

A pick for use with stringed musical instruments is disclosed. In some embodiments the pick is characterized by a roughened texture on the front and back substantially planar surfaces of the narrowed bottom portion of a substantially teardrop shaped body for the purpose of altering the tonal properties produced as it moves against strings that are strummed or picked. In further embodiments the roughened textured picking portion is combined with a separate second picking portion that is substantially smooth and useable to produce a conventional sound.

5 Claims, 5 Drawing Sheets

PICK FOR STRINGED MUSICAL INSTRUMENTS

FIELD OF THE INVENTION

The present invention relates generally to picks for stringed musical instruments. More particularly, the invention relates to stringed musical instrument picks that alter the tonal properties produced when the strings are strummed or picked.

BACKGROUND OF THE INVENTION

Musicians use a pick to pluck or strum the strings of a stringed musical instrument thereby causing them to vibrate and produce musical sounds and tones. A typical instrument pick is a small substantially teardrop shaped object having a broadened top finger grip portion and a narrowed bottom picking portion. In use, a musician holds the broadened top portion between the thumb and forefinger to guide the narrowed picking portion across the strings.

Picks of the prior art are substantially smooth on the front and back planar surfaces of the narrowed bottom portion so that they are nearly frictionless and soundless as they slide across the strings during strumming or plucking. Some picks of the prior art have a roughened textured on the broadened top finger grip portion to increase the gripping friction between the pick, thumb, and forefinger thereby making it less likely for the pick to be dropped unintentionally during use.

Frequently it is desirable for musicians to produce a number of differentiated tonal sounds in a single performance. By way of example, a musician may prefer to have a quiet subdued tone while playing behind a vocalist and a louder or more distorted tone during an instrument solo. The final perceived tonal sound is typically the summation of several tone altering apparatuses or selected features. Some examples include but are not limited to: engaging or disengaging electronic circuitry designed to distort or otherwise modify the electric signal of a stringed instrument's pickups, the type of amplifier used, the dimensions and material of the instrument body and strings, and the dimensions and material of the instrument pick.

In view of the foregoing there is a need for an improved design for a stringed musical instrument pick. For example it may be desirable for an improved pick to impart gritty or distorted tonal properties by nature of its design. It would be further desirable to be able to change the tonal properties imparted by the pick during a performance. Further still it would be desirable to include a means of changing the tonal properties quickly so as to not interrupt or delay the performance.

SUMMARY OF THE INVENTION

To achieve the foregoing and other objects in accordance with the purpose of the present invention, a variety of features are described to achieve a pick for stringed musical instruments.

A pick for use with stringed musical instruments is disclosed. In some embodiments the pick is characterized by a textured area on the front and back substantially planar surfaces of the narrowed bottom portion of a substantially teardrop shaped body for the purpose of altering the tonal properties produced as it moves against strings that are strummed or plucked. The textured area picking portion is combined with an acute curved terminal edge for the purpose of improved precision in manipulating strings during strumming or plucking. In further embodiments the textured area picking portion is combined with a separate second picking portion that is substantially smooth and useable to produce a conventional sound.

These embodiments and other features, objects, and advantages will become more fully apparent and more easily understood from the following detailed descriptions, which should be reviewed in conjunction with the provided drawings.

BRIEF DESCRIPTION OF THE DRAWINGS

The present invention is illustrated by way of example, and not by Way of in the figures of the accompanying drawings where.

DETAILED DESCRIPTION OF THE EMBODIMENTS

Embodiments of the invention are described in following text with reference to the Figures. However, those skilled in the art will readily appreciate that this description is for illustrative purpose and the invention extends beyond dimensions, patterns, and shapes described in these limited embodiments.

Figure 1:
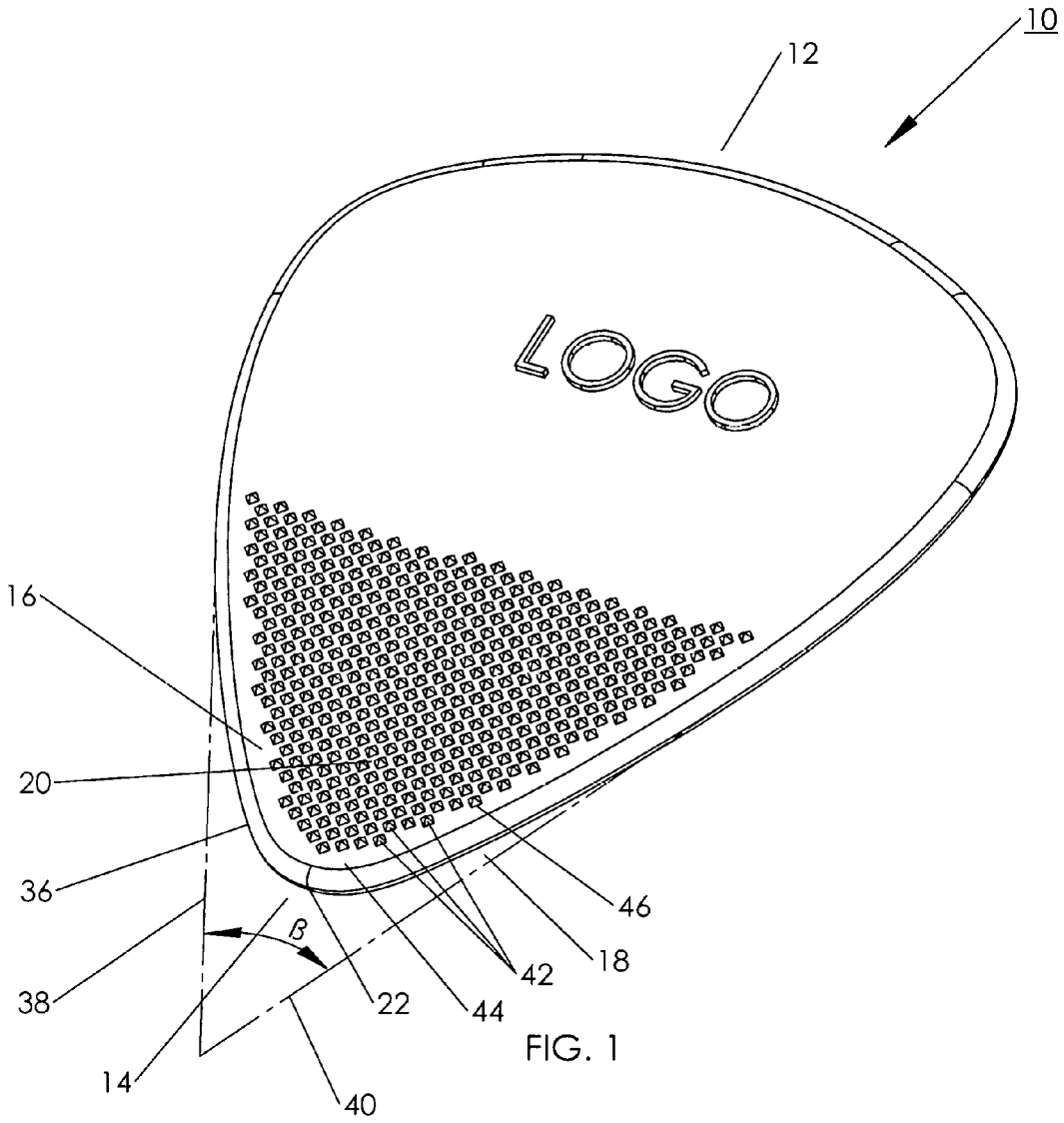
FIG. 1 is a perspective view Of a first instrument pick having features of the invention.
Figure 2:
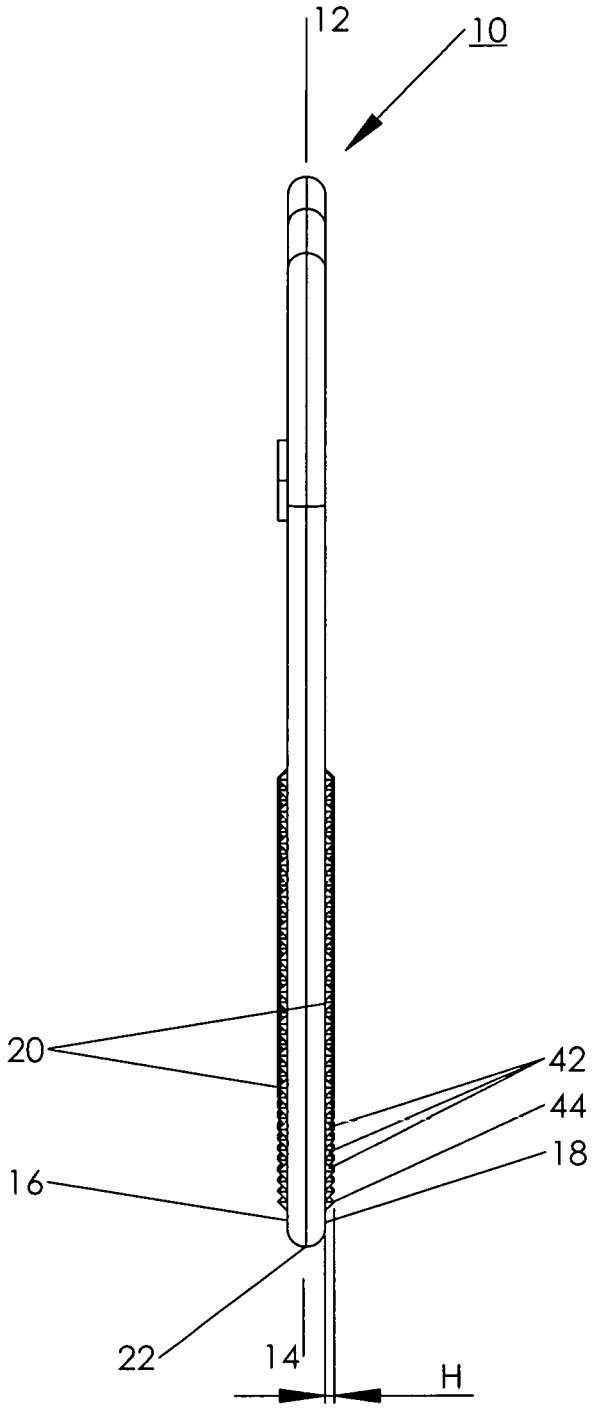
FIG. 2 is a side view of the instrument pick illustrated in HG 1.
Figure 3:
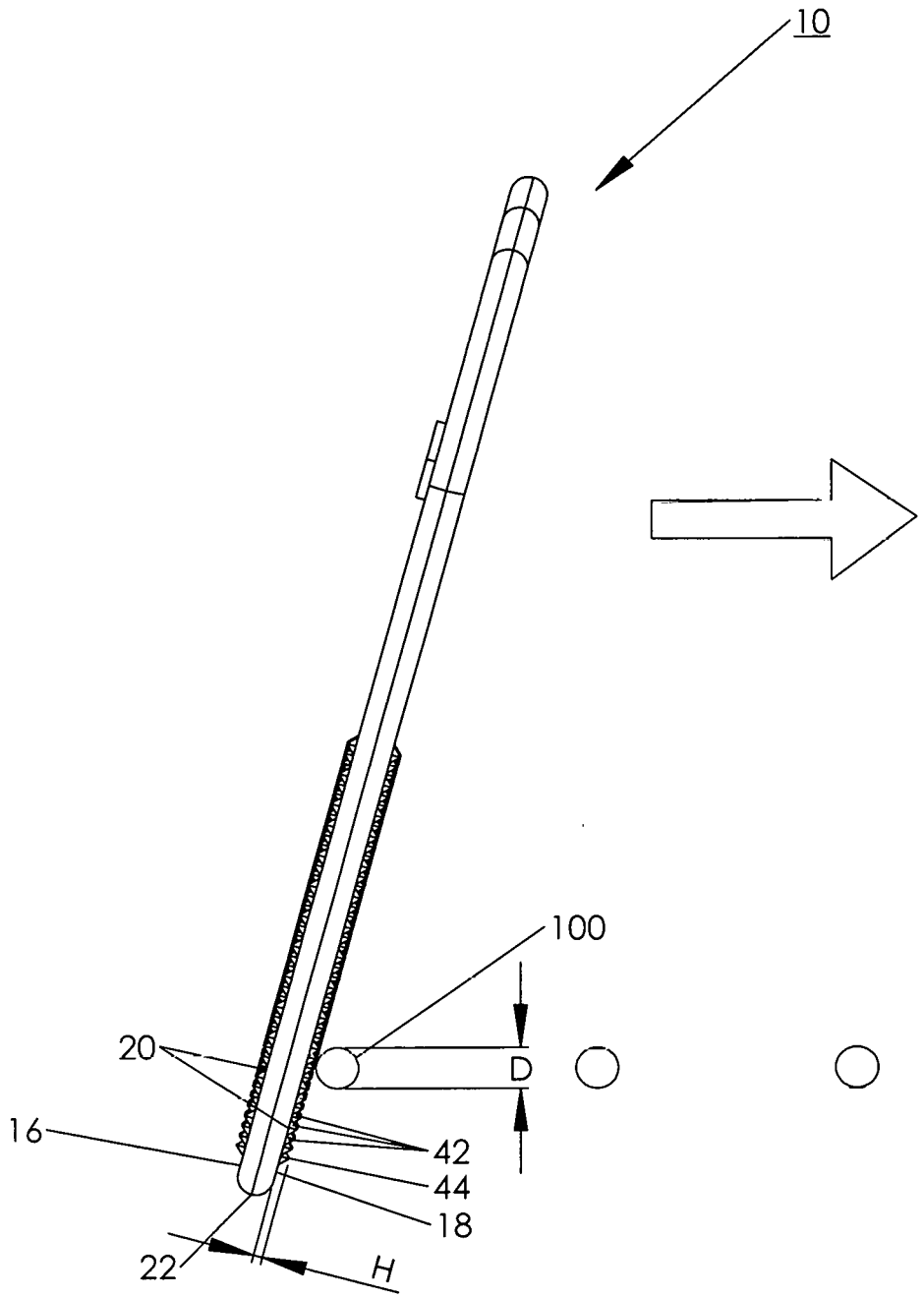
FIG. 3 is a side view of a pick having features of the invention striking the strings of a stringed musical instrument.

The invention is a pick 10 suitable for strumming or plucking the strings of a stringed musical instrument. FIGS. 1 and 2 show by way of example a teardrop shaped pick 10 with a broadened upper finger hold portion 12 and a narrowed lower picking portion 14. The narrowed lower picking portion 14 makes up approximately half the length of the entire pick 10. The upper finger hold portion 12 makes up the remaining approximate half of the length of the entire pick 10. The lower narrowed picking portion 14 has front and rear opposing faces 16, 18 which are characterized by textured areas 20. The narrowed picking portion 14 has a curved terminal edge 36 with an endmost tip 22. A portion of the curved terminal edge is defined by linear asymptotes 38, 40 with an interior angle β relative to each other. The linear asymptotic interior angle β is any specified angle less than 60 degrees. The textured areas 20 are characterized by a plurality of raised elements 42 arranged in a staggered pattern. The raised elements 42 terminate in a distal point or line 44. The height H of the distal point or line measured relative to the nearest of said front and rear opposing faces is any specified length sized to be less than half the diameter D of the instrument string 100 as illustrated by FIG. 3 while still sufficiently large to produce a desired audible raspy timbre. In view of extra light electric guitar string gauge standards the smallest gauge string diameter is 0.20 mm, and half its diameter is 0.10 mm accordingly. Similarly, in view of extra heavy bass guitar string gauge standards the largest string gauge diameter is 3.68 mm, and half its diameter is 1.84 mm accordingly. The height H is therefore any specified length between 0.10 mm and 1.84 mm sized in accordance with stringed musical instrument string gauge standards. The aspect ratio of each raised element is such that it is wider in base area 46 than tall in height H. Proportional to the raised element heights H listed previously the range of raised element base area 46 is any specified area size between 0.01 $mm^2$ and 3.39 $mm^2$. The front and rear opposing faces 16, 18 are coupled with at least 10 raised elements 42 within 8 mm of the endmost tip 22.

In use, the textured areas 20 of the front and rear faces 16, 18 make contact with the string 100 of a stringed musical instrument during strumming or plucking as illustrated in FIG. 3. As the textured area 20 moves across the string 100 the distal points and lines 44 of the plurality of raised elements 42 engage and disengage the string in quick succession producing a "raspy" or "gritty" timbre which is both pleasant and novel. When the textured area 20 portion of the pick has moved sufficiently far along the string 100 so as to reach the endmost tip 22 of the curved terminal edge 36 the string is released to vibrate freely thereby producing a final resulting musical sound or tone. In use, moving 10 or more staggered raised elements 42 against the string 100 in a span of 8 mm before reaching the endmost tip 22 audibly sustains the "raspy" or "gritty" timbre for a sufficiently long and pleasing length of time relative to the final resulting musical sound or tone produced when the string 100 is released from the endmost tip 22. Fewer than 10 raised elements within 8 mm the endmost tip 22 produces an undesirable "chirping" sound rather than a sustained gritty or raspy timbre. The linear asymptotic interior angle β of less than 60 degrees improves the precision of the pick in releasing the string in musical timing from the textured area 20. Furthermore, the linear asymptotic interior angle β of less than 60 degrees allows the textured areas 20 to further penetrate the gap between adjacent strings 100 before moving across said strings, thereby improving the precision of the pick in contacting any desired strings to produce sounds and tones in musical sequence without unintentionally contacting any undesired adjacent strings. The plurality of raised elements 42 arranged in a staggered pattern and their termination in a point or line 44 provide a continuous friction of a plurality of raised elements engaging and disengaging the string 100 concurrently thereby providing a predictable and even tonal effect. The raised element height H of less than half the string diameter D allows the textured area 20 to move across the string 100 in quick succession without the ill-advantageous forcible jolt of individual raised elements hooking on the string during strumming or plucking. The aspect ratio of the raised elements 42 wider at their base area 46 than tall in height H improves the resilience of the raised elements against bending deformation or premature wear in moving against the instrument string 100.

In the prior art, any narrowed picking portions with textured areas have a curved terminal edge defined by linear asymptotes with an interior angle equal to or greater than 60 degrees and thereby provide a blunted picking portion that is less precise in manipulating the strings of a stringed musical instrument in musical sequence and timing. Furthermore, picks of the prior art have fewer than 10 raised elements within 8 mm of the endmost point of their curved terminal edge with linear asymptotes with an interior angle of less than 60 degrees and thereby are incapable of producing the sustained and novel raspy or gritty timbre achieved by the present invention. Further still, any picks of the prior art with textured areas in the narrowed picking portions defined by linear asymptotes with an interior angle less than 60 degrees in the are not characterized by a plurality of raised elements terminating in a distal point or line and are not arranged in a staggered pattern and thereby do not provide a continuous friction of a plurality of raised elements engaging and disengaging the strings concurrently but instead provide a forcible jolt that is ill-advantageous in strumming or plucking.

Figure 4:
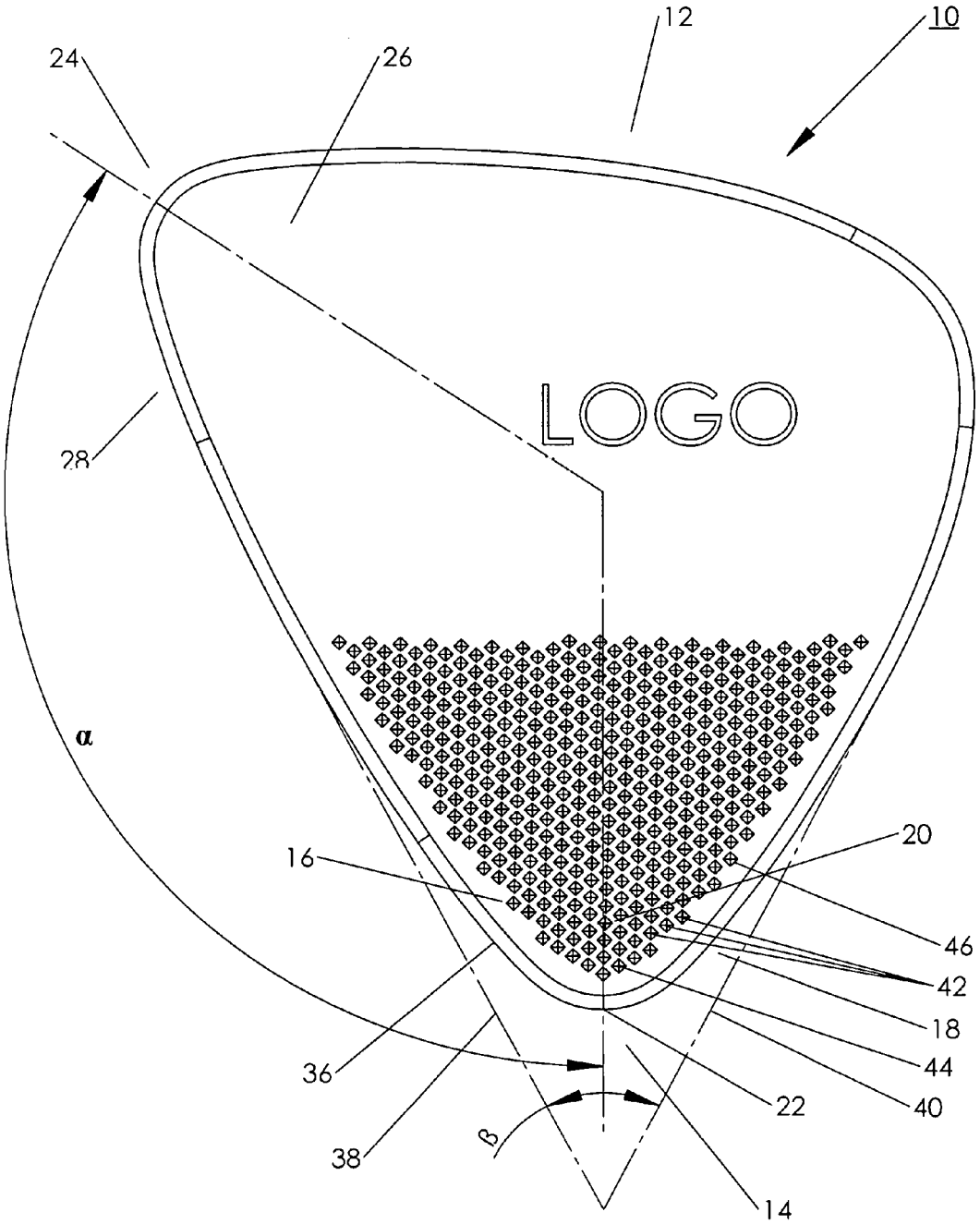
FIG. 4 is a front view of a second instrument pick having features of the invention.

FIG. 4 illustrates a pick constructed in accordance with another embodiment of the invention. The body of the pick includes the profile of a second narrowed picking portion 24 that is angularly disposed relative to the adjacent lower textured narrowed picking portion 14. The second narrowed picking portion 24 can be disposed at a variety of angles α with respect to the lower narrowed picking portion 14. Typically the second narrowed picking portion 24 is disposed between 40 and 180 degrees with respect to the lower narrowed picking portion 14.

Figure 5:
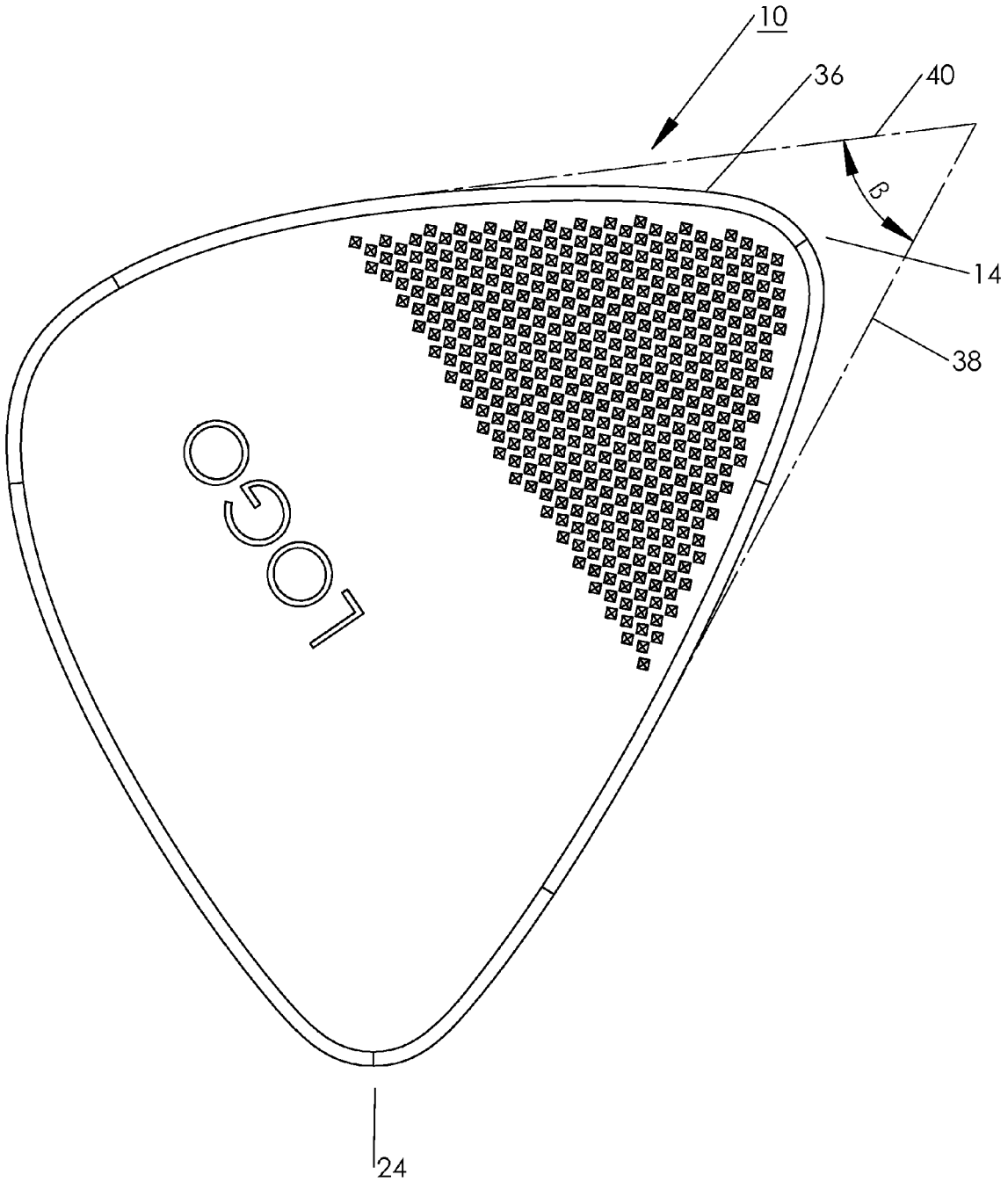
FIG. 5 is a front view of the instrument pick illustrated in FIG. 4, rotated to illustrate how a musician could orientate the pick to use the second narrowed picking portion.

The second narrowed picking portion 24 is substantially smooth on its front and rear surfaces 26, 28. In use, the musician can use the roughened texture narrowed portion 14 of the pick to produce a unique "gritty" timbre as described above, or rotate the pick to strum or pluck the strings with the second smooth narrowed portion 24 to produce a conventional sound. FIG. 5 shows by way of illustration the pick of FIG. 4 rotated so that the second narrowed picking portion 24 is in position for use by the musician.

The invention has been described above by way of illustration, and the specific embodiments disclosed are not intended to limit the invention to the exact construction and operation shown and described. It is to be noted that other equivalents or substitutions will occur to those skilled in the art without departing from the spirit and scope of the present invention as described in the claims. For example, the areas of roughened texture 20 could be achieved by a formation of any conceivable shape, or pattern, both random or geometric, both integrated or adhered or formed in a post process, and still fall within the scope of the present invention.

What is claimed:

1. A pick for use with stringed musical instruments comprising:

a front face and an opposing rear face, and a textured area coupled with said surfaces each said front and rear face wherein said textured areas have a narrowed picking portion with a curved terminal edge and an endmost tip, and wherein a portion of said curved terminal edge is defined by linear asymptotes with an interior angle of less than 60 degrees relative to each other thereby increasing the depth of penetration of the textured areas into the space between adjacent strings of a stringed musical instrument before engaging the strings in plucking or strumming and thus improving the precision of the textured areas in contacting any desired strings to produce sounds in musical sequence and timing without unintentionally contacting any undesired adjacent strings;

wherein said textured areas are characterized by a plurality of raised elements, and wherein said raised elements terminate in a distal point or line, and thereby are capable of engaging and disengaging an individual string of a stringed musical instrument in quick succession as they move against it and thus produce a raspy timbre before the string is released to vibrate freely producing a final resulting conventional tone;

wherein said plurality of raised elements are arranged in a staggered pattern thereby providing a continuous friction of a plurality of raised elements engaging and disengaging said string concurrently;

wherein said distal point or line is at least 0.10 mm but not more than 1.84 mm in height relative to the nearest of said front and rear opposing faces such that the height of said plurality of raised elements is sized less than half the diameter of the string and thereby capable of moving against the string in quick succession without jolting;

wherein each said raised element has a base area that is at least 0.01 $mm^2$ but not more than 3.39 $mm^2$ whereby the resulting base area to height aspect ratio is wider at its base area than tall in its height and thus resilient against bending deformation or premature wear in moving against the strings;

wherein each said textured area of said front and rear faces are coupled with at least 10 said raised elements positioned within 8.00 mm of said endmost tip whereby the raspy timbre produced is sustained before the string is released to vibrate freely producing a final resulting conventional tone.

2. A pick for use with stringed musical instruments comprising:

a front face and an opposing rear face, and a textured area coupled with each said front and rear face wherein said textured areas have a narrowed picking portion with a curved terminal edge, and wherein a portion of said curved terminal edge is defined by linear asymptotes with an interior angle of less than 60 degrees relative to each other thereby increasing the depth of penetration of the textured areas into the space between adjacent strings of a stringed musical instrument before engaging the strings in plucking or strumming and thus improving the precision of the textured areas in contacting any desired strings to produce sounds in musical sequence and timing without unintentionally contacting any undesired adjacent strings;

wherein said textured areas are characterized by a plurality of raised elements and thereby are capable of engaging and disengaging an individual string of a stringed musical instrument in quick succession as they move against it and thus produce a raspy timbre before the string is released to vibrate freely producing a final resulting conventional tone;

wherein said plurality of raised elements are arranged in a staggered pattern thereby providing a continuous friction of a plurality of raised elements engaging and disengaging said string concurrently.

3. The pick of claim 2, wherein the curved terminal edge has an endmost tip, and wherein each said textured area of said front and rear faces are coupled with at least 10 said raised elements positioned within 8.00 mm of said endmost tip, whereby the raspy timbre produced is sustained before the string is released to vibrate freely producing a final resulting conventional tone.

4. The pick of claim 2, wherein said raised elements terminate in a distal point or line, and wherein said distal point or line is at least 0.10 mm but not more than 1.84 mm in height relative to the nearest of said front and rear opposing faces such that the height of said plurality of raised elements is sized less than half the diameter of the string and thereby capable of moving against the string in quick succession without jolting.

5. The pick of claim 4, wherein each said raised element has a base area that is at least 0.01 $mm^2$ but not more than 3.39 $mm^2$ whereby the resulting base area to height aspect ratio is wider at its base area than tall in its height and thus resilient against bending deformation or premature wear in moving against the strings.

* * * * *